United States Patent [19]

Kingsford et al.

[11] Patent Number: 4,981,418

[45] Date of Patent: Jan. 1, 1991

[54] INTERNALLY PRESSURIZED BELLOWS PUMP

[75] Inventors: Kenji A. Kingsford, Devore; Anthony K. Chan, Alhambra, both of Calif.

[73] Assignee: Osmonics, Inc., Minnetonka, Minn.

[21] Appl. No.: 385,855

[22] Filed: Jul. 25, 1989

[51] Int. Cl.[5] ..... F04B 43/06; S18E 54/10

[52] U.S. Cl. ..... 417/63; 417/397; 340/605

[58] Field of Search ..... 417/394, 395, 397, 472, 417/473, 46, 63; 340/605

[56] References Cited

U.S. PATENT DOCUMENTS

| | | | |
|---|---|---|---|
| 2,578,265 | 12/1951 | Saalfrank | 417/63 |
| 2,970,546 | 2/1961 | White | 417/397 |
| 3,782,863 | 1/1974 | Rupp | 417/397 |
| 3,807,906 | 4/1974 | Breit | 417/63 |
| 4,159,420 | 6/1979 | Tsunoda | 340/605 |
| 4,272,959 | 6/1981 | Yamane | 340/605 |
| 4,444,545 | 4/1984 | Sanders et al. | 417/63 |
| 4,781,535 | 11/1988 | Frawley et al. | 340/605 |
| 4,847,599 | 7/1989 | Imiolex et al. | 340/605 |
| 4,854,832 | 8/1989 | Gardner et al. | 417/395 |
| 4,858,478 | 8/1989 | Kush et al. | 417/63 |

*Primary Examiner*—A. Michael Chambers

[57] ABSTRACT

A bellows-type pump has a plastic bellows interiorly supported by interior pressure. The interior pressure is supplied by a fluid source which passes through a pressure regulator to control the amount of interior pressure exerted on the bellows. A fiber-optic leak detector can be inserted into the plastic bellows to detect the leakage of process fluid therein.

11 Claims, 2 Drawing Sheets

INTERNALLY PRESSURIZED BELLOWS PUMP

FIELD OF THE INVENTION

This invention relates to a bellows-type pump and, in particular, to an improved method of interiorly supporting a plastic pumping bellows.

BACKGROUND OF THE INVENTION

To permit pumping of corrosive fluids such as high-temperature acids and the like, particularly in the semiconductor industry, positive displacement pumps have been developed which utilize a plastic bellows as a pumping member. Such bellows is typically constructed of Teflon and has a plurality of coils flexibly joined together to define an extendable and contractible sleeve, one end of which is closed, and the other end of which has a movable piston rod extending therethrough. This bellows is movably disposed within a pumping chamber in which the pumped fluid is alternately supplied and discharged. The bellows, in the interior thereof, is attached to the piston rod, and is alternatively extended and contracted to effect a pumping operation by reciprocating movement of the piston rod.

With this known pump, which is typically a double acting arrangement having a pair of bellows connected to opposite ends of and simultaneously driven by a common driver, it has been conventional to provide an interior support ring within each coil of the bellows to prevent inward collapse of the bellows during the pressurizing and pumping operation (that is, during the axial extension of the bellows). Such support ring typically comprises an elongate rod of spring material which is rolled to form a loop of a diameter slightly smaller than the interior diameter of the bellows coil. This loop is inserted into the bellows and then radially expanded so as to fill out and radially support the bellows coil. The ends of the split loop, which ends are flat, are disposed in abutting engagement with one another to hold the loop expanded and to form a substantially continuous ring for radially outwardly supporting the bellows coil. However, with this arrangement, it has been observed that the abutting ends of the support loop can become dislodged from one another. Thus, the loop tends to radially contract and the ends create edges which can effect undesired wear and possible puncturing of the thin plastic bellows.

This known pump is also extremely limited in its service application in that, due to the fragility of the plastic bellows, only about a 30 to 35 psi pumping pressure can be tolerated when a high temperature fluid, such as an acid at about 180° C., is being pumped, even when support rings are provided in the bellows. Since the capacity of this bellows-type pump is directly proportioned to its pumping pressure, its capacity and range of service in the pumping of high temperature fluids is extremely limited.

Accordingly, this invention relates to an improved bellows-type pump which overcomes the aforementioned disadvantages. More specifically, the improved bellows-type pump of this invention incorporates a means for internally pressurizing the interior of the pump bellows so that the discharge pressure of the pump, and its pumping capacity, can be greatly increased. In the preferred embodiment, the pump has a pair of bellows which operate out of phase, and the pressure in each bellows is maintained substantially constant, and the pressure in the pair of bellows is equalized.

In another embodiment of the present invention, the bellows does not contain a support ring and is internally supported only by the means for pressurizing the interior of the bellows thereby eliminating wear points in the bellows.

In a still further embodiment of the present invention, the means for internally pressurizing the bellows additionally comprises a leak detector means for determining the leakage of process fluid into the bellows and shutting down the pump if necessary, thereby eliminating the danger of process fluid leakage into the environment.

Other objects and purposes of the invention will be apparent to persons familiar with pumps of this general type upon reading the following specification and inspecting the accompanying drawings.

Figure 1:
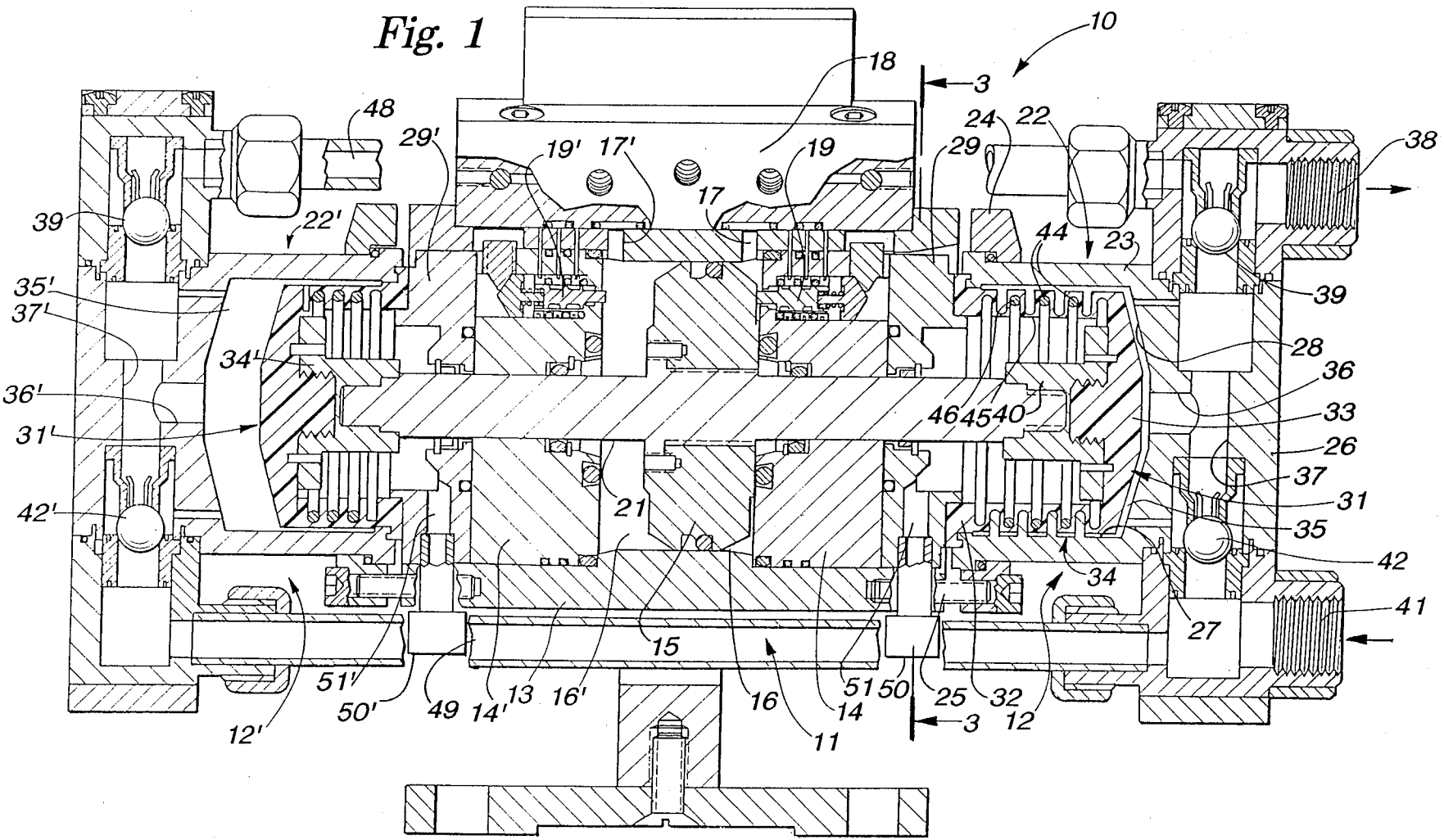
FIG. 1 is a central cross sectional view of a double-acting bellows-type pump of the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the pump and designated parts thereof. Said terminology will include the words specifically mentioned, derivatives thereof, and words of similar import.

DETAILED DESCRIPTION

Referring to FIG. 1, there is illustrated a double-acting bellows-type pump 10 of the present invention.

More specifically, the pump 10 includes a center driving section 11 for causing alternate actuation of pumping sections 12 and 12' disposed on opposite ends of the driving section.

The driving section 11 includes a housing defined by a sleevelike housing part 13 sealingly closed at opposite ends by end plates 14 and 14'. A driving piston 15 is slidably and sealingly supported within the housing part 13 and defines pressure chambers 16 and 16' on opposite sides thereof. Pressurized air is supplied to and exhausted from the chambers 16 and 16' via the respective ports 17 and 17'. These latter ports communicate with a conventional valve assembly 18, such as a conventional five-port, four-way flow valve for controlling flow of a pressurized fluid into and out of the chambers 16 and 16'. Such valves 18 are well known so that detailed description thereof is believed unnecessary.

The shifting of the main flow control valve 18 is controlled by suitable pilot valves 19 and 19' which are respectively mounted on the end plates 14 and 14'. These pilot valves 19 and 19' comprise conventional three-way valves each having a spring-urged stem which projects outwardly into the respective chamber 16 or 16' for contact with the piston 15 to effect reversal of the main control valve 18 and hence reversal in the pressurization of the chambers 16 and 16', which in turn causes reversal in the direction of movement of the driving piston 15.

The driving piston 15 is secured to an elongate piston rod 21 which projects axially outwardly in opposite directions from the piston 15, with the piston rod projecting slidably through the end plates 14 and 14' while being maintained in sealed engagement therewith.

Considering now the pumping section 12, it includes a pump head 22 which is fixedly secured to one end of the center housing. The pump head 22 includes a generally cylindrical side wall 23 which at its inner end is coupled to a surrounding flange 24, the latter being fixed to the adjacent end of the housing part 13, such as by screws 25. The cylindrical housing sleeve 23, at its other end, terminates in a transversely extending end plate 26.

The pump head 22 defines therein a generally cylindrical chamber which is surrounded by the interior cylindrical wall 27 and which extends axially from an interior end wall 28 until terminating at an end member 29, the latter being fixed relative to the housing directly adjacent the end plate 14.

The driving section 12 includes a pumping bellows 31 disposed within the chamber of the pump head 22, which bellows 31 at its axially inner end is provided with an annular mounting flange 32 which is fixedly clamped between the housing sleeve 23 and the end plate 29. The pumping bellows at its other axial end has a transversely extending pressure wall 33. The wall 33 and flange 32 are axially joined together by an axially extendable and contractible sleevelike side wall 34, as explained below. The pressure wall 33 of the bellows is fixedly joined to a coupling plate 40 which is disposed interiorly of the bellows, and this coupling plate 40 in turn is fixedly secured to the free end of the piston rod 21, whereby the bellows is disposed so as to be generally coaxially aligned with the longitudinal axis of the piston rod.

The exterior of the bellows cooperates with the housing walls 27 and 28 so as to define a pumping chamber 35 therebetween. A supply/discharge passage 36 opens coaxially from the pumping chamber through the end wall 28 for communication with a transversely extending passage 37 as formed in the end part 26. An upper portion of this transverse passage 37 functions as a fluid discharge passage in that it communicates with a fluid discharge port 38 through an appropriate one-way check valve 39. The lower end of transverse passage 37 similarly communicates with a fluid supply port 41 through an appropriate one-way check valve 42.

As to the construction of the pumping bellows 33, it is preferably constructed in one-piece of a plastics material, preferably TFE Teflon, so as to have the capability of handling high temperature and/or corrosive fluids, such as acids. The axially extendable and contractible sleevelike side wall 34 can include a plurality of annular coils 44 which are positioned axially adjacent one another, which coils 44 have a diameter slightly smaller than the interior diameter of the cylindrical wall 27 of the pumping chamber. The coil 44, in cross section, has a generally U-shaped configuration which opens radially inwardly. The radially inner ends of the legs of adjacent coils 44 are integrally axially joined together by a flexible annular membrane or wall 45. To interiorly support the individual coils 44, each is conventionally provided with a support ring 46 confined interiorly within the U-shaped cross section thereof.

The driving section 12' disposed at the other end of the pump is structurally and functionally identical to the driving section 12, and hence the parts of the section 12' are designated by the same reference numerals used to designate the corresponding parts of section 12 except for the addition of a prime (') thereto.

To facilitate the construction of the pump and particularly to minimize the number of external connections, the discharge and supply ends of the transverse passage 37' respectively communicate with intermediate passages 48 and 49, the latter in turn being respectively disposed in direct communication with the ports 38 and 41.

With the double acting pump arrangement illustrated by FIG. 1, the pumping sections 12 and 12' are driven out of phase with one another such that when the bellows 33 is being expanded rightwardly in FIG. 1 so as to pressurize the fluid in chamber 35 and discharge it outwardly through the port 38, the other bellows 31' is being contracted so as to draw fluid into the pumping chambers 35', and vice versa.

The pump construction as defined above is conventional.

Figure 2:
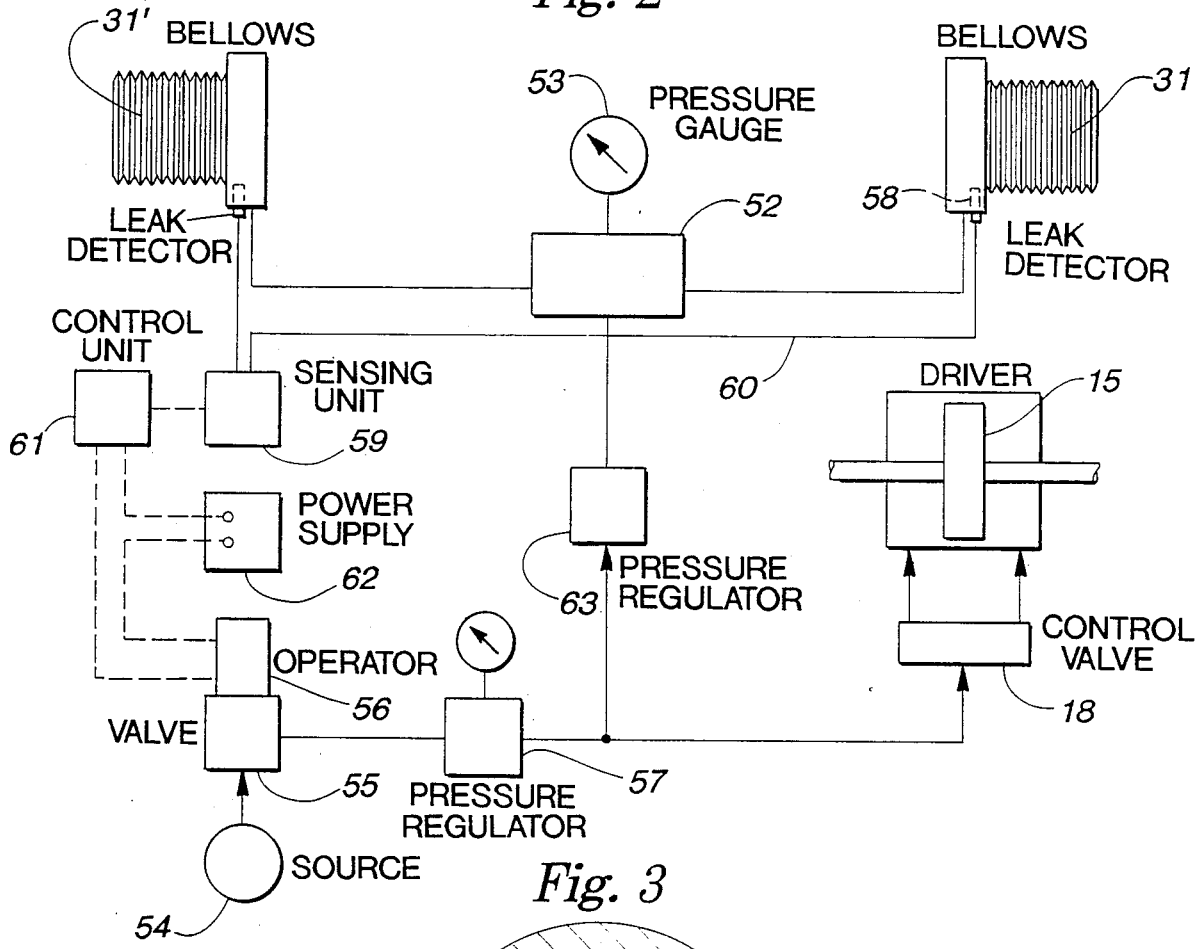
FIG. 2 is a schematic diagram of the control system of the present invention.

Pressurized fluid inlet ports 50 and 50' are connected to passages 51 and 51' which are formed in end members 29 and 29' for communication with the interior of the respective bellows. As shown in FIG. 2, pressurized fluid inlet ports 50 and 50' are connected to a common manifold 52 so that the pressures exerted in the interiors of the bellows 31 and 31' are equalized and are maintained substantially constant as the bellows extend and contract. By maintaining equal and substantially constant pressures inside the two bellows, stresses on the bellows which induce fatigue are reduced, thereby extending the life of the bellows. Further, by pressurizing the interior of the bellows, this permits use of a higher pumping pressure within the pumping chambers, and hence permits a higher pumping output. The internal support of the bellows provided by interior pressurization also enables the pump to be constructed while eliminating the need for the interior support rings 46.

A pressure gage 53 can be contained in the manifold to monitor the pressure therein. The pressurized fluid is supplied from a source 54 and passes through a valve 55 with an operator 56 and a first pressure regulator 57 before it is split into two streams. The first pressure regulator 57 adjusts the pressure of the first stream to a desired amount before it is introduced into main flow control valve 18. The second stream passes through a second pressure regulator 63 where the pressure of the second stream is adjusted before it enters the manifold 52 for the pressure fluid inlet ports 50. Any suitable type of fluid such as a liquid or a gas may be used as the pressurized fluid, with air being preferred.

Figure 3:
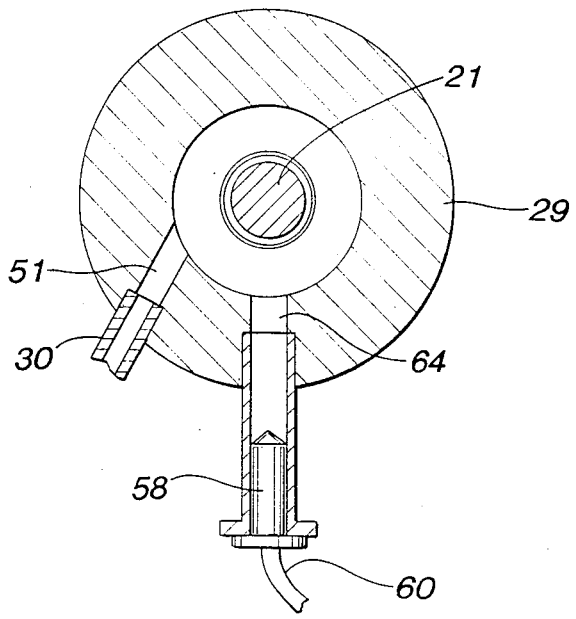
FIG. 3 is a partial cross-sectional view illustrating the leak detector of the present invention.

As shown in FIGS. 2 and 3, a leak detector also preferably communicates with the interior of each bellows for detecting leaks of process fluid therein. The leak detector is a conventional fiber-optics type comprising a sensing head 58 connected to a sensing unit 59 by a fiber-optics cable 60. Light is emitted through the cable 60, passes through the sensing head 58 and reflects back to the sensing unit 59 when no liquid is present on the sensing head 58. The sensing head is positioned within an opening 64 which projects upwardly through the respective end member 29 or 29' for communication with the interior of the respective bellows at the lowest point therein. When a leak into the bellows is occurring, liquid will flow by gravity into the opening 63 so as to collect on the sensing head 58 and scatter the light passing therethrough. When the interruption of the reflected light is detected, the sensing unit 59 can send a signal to a control unit 61 which can turn off the pump by instructing an operator 56 to close the valve 55 in the line carrying the pressurized fluid or by shutting off the power supply 62 to the operator 56 which will cause the valve 55 to close.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a bellows-type pump for pumping acids and the like, including a pump head defining therein an enlarged chamber, a reciprocal driver including a reciprocal driving rod projecting coaxially into said enlarged chamber, and axially elongate and flexible pumping bellows disposed in surrounding relationship to said driving rod and sealingly connected between said driving rod and said pump head so as to define a pumping chamber between said pumping bellows and opposed walls of said enlarged chamber, said bellows being constructed of a plastics material and at one end having an end wall which extends transversely across the pumping chamber and is fixedly secured to a free end of said driving rod, said bellows at the other end having an annular mounting flange which is fixedly and sealingly secured relative to the pump head, said bellows further including an axially elongate and sleevelike side wall which substantially concentrically surrounds a part of said driving rod and which extends axially between said end wall and said mounting flange, said sleevelike side wall including a plurality of axially adjacent annular coils each having a generally U-shaped cross section which opens radially inwardly, and passage means formed in said pump head and communicating with said pumping chamber for permitting a pumped fluid to be supplied into and discharged out of said pumping chamber during each reciprocal cycle of said pumping bellows, the improvement comprising means for internally pressurizing said pumping bellows and for maintaining substantially constant pressure within said bellows.

2. A pump according to claim 1, wherein said pump additionally comprises means for detecting a leak of said pumped fluid into said pumping bellows.

3. A pump according to claim 2, wherein said means for detecting a leak comprises a fiber-optic leak detector.

4. A pump according to claim 2, wherein said coils are free of interior support rings.

5. A pump according to claim 1, wherein said coils are free of interior support rings.

6. A bellows-type pump for pumping acids and the like, comprising:

pump head means defining therein first and second enlarged chambers disposed in generally but axially spaced relationship from one another;

reciprocal driver means disposed between said chambers and including an elongate reciprocal driving rod having opposite ends which project coaxially into said first and second chambers, a driving piston secured substantially centrally to said rod, and means for supplying pressurized air alternately to opposite sides of said driving piston for effecting reciprocal movement of said driving rod;

first and second axially elongate and flexible pumping bellows disposed within the respective first and second enlarged chambers in surrounding relationship to the driving rod and sealingly connected between the driving rod and said pump head so as to define first and second pumping chambers between the respective pumping bellows and opposed walls of the respective enlarged chamber;

each said bellows being constructed of a plastics material and at one end having an end wall which extends transversely across the pumping chamber and is fixedly secured to a free end of said driving rod, each said bellows at the other end having an annular mounting flange which is fixedly and sealing secured relative to the pump head, each said bellows further including an axially elongate and sleevelike side wall which substantially concentrically surrounds a part of said driving rod and which extends axially between said end wall and said mounting flange, said sleevelike side wall including a plurality of axially adjacent annular coils;

passage means formed in said pump head and communicating with each said pumping chamber for permitting a pump fluid to be supplied into and discharged out of said pumping chamber during each reciprocal cycle of the respective bellows; and means for maintaining pressurized air within the interior of each of said first and second bellows and for maintaining substantial equalization of the pressure within the interior of each of said first and second bellows, said means including first and second ports which respectively communicate with the interior of said first and second bellows and a communicating passage which continuously joins said first and second ports to provide continuous free communication between the interior of said first and second bellows to permit equalization of the air pressure therein.

7. A pump according to claim 6, wherein said last-mentioned means maintains a substantially constant pressure within the interior of said first and second bellows.

8. A pump according to claim 6, wherein said communicating passage is connected via a supply passage to a source of pressurized air, and pressure regulating means associated with said supply passage for controlling the pressure of air supplied into the interior of said first and second bellows.

9. A pump according to claim 6, including means communicating with a lower portion of the interior of each of said first and second bellows for detecting leakage of the pumped fluid into the interior of said bellows.

10. A pump according to claim 6, wherein the coils of each said bellows are free of interior support rings.

11. A bellows-type pump for pumping acids and the like, comprising:

pump head means defining therein first and second enlarged chambers disposed in generally but axially spaced relationship from one another;

reciprocal driver means disposed between said chambers and including an elongate reciprocal driving rod having opposite ends which project coaxially into said first and second chambers, a driving piston secured substantially centrally to said rod, and means for supplying pressurized air alternately to opposite sides of said driving piston for effecting reciprocal movement of said driving rod;

first and second axially elongate and flexible pumping bellows disposed within the respective first and second enlarged chambers in surrounding relationship to the driving rod and sealingly connected between the driving rod and said pump head so as to define first and second pumping chambers between the respective pumping bellows and opposed walls of the respective enlarged chamber;

each said bellows being constructed of a plastics material and at one end having an end wall which extends transversely across the pumping chamber and is fixedly secured to a free end of said driving rod, each said bellows at the other end having an annular mounting flange which is fixedly and sealing secured relative to an end plate of said pump head, each said bellows further including an axially elongate and sleevelike side wall which substantially concentrically surrounds a part of said driving rod and which extends axially between said end wall and said mounting flange, said sleevelike side wall including a plurality of axially adjacent annular coils;

passage means formed in said pump head and communicating with each said pumping chamber for permitting a pump fluid to be supplied into and discharged out of said pumping chamber during each reciprocal cycle of the respective pumping bellows; and leak detector means disposed in communication with the interior of each of said first and second bellows for detecting leakage of pump fluid into the interior of either said bellows, said leak detector means including a passageway projecting generally vertically upwardly through said end plate for communication with the interior of the respective bellows substantially at the lowermost point thereof, and a leak detector head disposed within said passageway so that any leakage of pump fluid into the interior of the respective bellows will readily flow into said passageway.

* * * * *